US007181848B1

(12) United States Patent
Tochtrop

(10) Patent No.: US 7,181,848 B1
(45) Date of Patent: Feb. 27, 2007

(54) MULTIPLE USE ROTARY CUTTING DEVICE

(76) Inventor: Jeffrey L. Tochtrop, 11050 Torigney Dr., St. Louis, MO (US) 63126

( * ) Notice: Subject to any disclaimer, the term of this patent is extended or adjusted under 35 U.S.C. 154(b) by 230 days.

(21) Appl. No.: 10/884,265

(22) Filed: Jul. 6, 2004

(51) Int. Cl.
*B26B 3/06* (2006.01)
*B26B 11/00* (2006.01)

(52) U.S. Cl. ..... 30/123; 30/143; 30/151; 30/294; 30/319

(58) Field of Classification Search ..... 30/143, 30/320, 2, 314, 317, 319, 294, 292, 151, 30/152, 162, 164, 123, 123.5, 123.6, 123.7, 30/142, 145, 146; 7/110, 113, 158, 160, 7/162

See application file for complete search history.

(56) References Cited

U.S. PATENT DOCUMENTS

| | | | | | |
|---|---|---|---|---|---|
| D222,380 | S | * | 10/1971 | Fraioli | D7/694 |
| 4,077,124 | A | * | 3/1978 | Christmann | 30/287 |
| 4,423,551 | A | | 1/1984 | Chmela et al. | |
| 4,974,320 | A | * | 12/1990 | Pelletier | 30/123 |
| 5,428,898 | A | | 7/1995 | Hawkins | |
| 5,438,757 | A | * | 8/1995 | Weschenfelder | 30/139 |
| 5,480,031 | A | | 1/1996 | Maultasch et al. | |
| 5,649,365 | A | * | 7/1997 | Yang | 30/319 |
| 5,778,536 | A | * | 7/1998 | West | 30/123 |
| D441,631 | S | * | 5/2001 | Carroll | D8/98 |
| 6,438,850 | B2 | | 8/2002 | Young et al. | |
| 6,591,503 | B1 | | 7/2003 | Voves | |
| 7,021,773 | B2 | * | 4/2006 | Ishino | 353/119 |
| 2002/0129499 | A1 | | 9/2002 | Khatchadourian et al. | |

* cited by examiner

*Primary Examiner*—Stephen Choi
(74) *Attorney, Agent, or Firm*—Kevin L. Klug

(57) ABSTRACT

A multiple use rotary cutting device having an accessory cutting mechanism for use with prepackaged food products such as pizza. The rotary cutting device provides multiple functions which enhance the convenience of use. The device further minimizes the quantity of devices which must be cleaned after use. The multiple use rotary cutting device has a cutting wheel; a frame member with a lower portion having a accessory cutting surface; a handle assembly comprising a handle cover and a handle for partially enclosing the lower portion of the frame member; and a retracting assembly, which in combination with the handle is capable of completely enclosing the lower portion of the frame member. The accessory cutting mechanism is capable of cutting open a prepackaged food product and the rotary cutting wheel is capable of cutting or slicing the food product itself. When the retracting assembly is compressed, the lower portion of the frame member which is not enclosed by the handle is thereby exposed and provides an accessory cutting mechanism upon demand.

10 Claims, 4 Drawing Sheets

MULTIPLE USE ROTARY CUTTING DEVICE

BACKGROUND OF THE INVENTION

The present invention relates in general to rotary cutting devices for use in cutting/sectioning food products. This rotary cutting device includes an accessory cutting mechanism which represents a significant improvement over conventional rotary food cutting tools. Additionally, the accessory cutting mechanism significantly increases the convenience of the device.

When opening prepackaged food products, such as frozen pizza, it is typically necessary to utilize a separate cutting device, such as a knife or scissors, to open the package. The present art accessory cutting mechanism of the rotary cutting device accomplishes this task by pivoting the rotary cutting device whereby the accessory cutting mechanism faces the prepackaged food product to be opened. In the preferred embodiment, the accessory cutting mechanism is enclosed by a retracting assembly which safely covers the accessory cutting surface and further provides an aesthetic appeal. Upon application of pressure (i.e. compressive force), the retracting assembly retracts, thereby exposing the previously concealed accessory cutting surface. While maintaining appropriate pressure, the device is easily pushed and/or pulled until the accessory cutting surface cuts open the packaging.

Thereafter, the device is available to cut or section the food product by pivoting the device until the cutting wheel faces the food product. Pressure is then applied and the device is pushed and/or pulled whereby the cutting wheel rotates freely and the wheel's rotary cutting surface cuts the food product. The multiple use rotary cutting device provides the necessary package cutting and rotary cutting tools in one device. Prior art alternatives typically utilize multiple tools, such as a knife or scissors, to open the package and a conventional rotary pizza cutter to cut the pizza. As such, the conventional alternatives are undesirable from both a convenience and efficiency standpoint.

Accordingly, it is an object of the present invention to provide a multiple use rotary cutting device having an accessory cutting mechanism which is capable of cutting and opening the packaging, of prepackaged food products; and a rotary cutting wheel capable of cutting the food product after the package has been opened, either before or after cooking.

Another object of the present invention is to provide a multiple use rotary cutting device having an accessory cutting mechanism which when not utilized is substantially and safely concealed within a handle or retracting assembly such that the accessory cutting surface is not exposed unless adequate pressure is applied.

A further object of the present invention is to provide a multiple use rotary cutting device which is lightweight and easy to use.

SUMMARY OF THE INVENTION

To accomplish the foregoing and other objects of this invention there is provided a multiple use rotary cutting device having an accessory cutting mechanism which in the preferred embodiment is covered by a retracting assembly. The accessory cutting mechanism is preferably opposite the rotary cutting wheel. The accessory cutting mechanism is capable of cutting and opening the packaging of prepackaged food products. When the rotary cutting device is pivoted, the rotary cutting wheel excels at cutting or slicing the food product which was previously enclosed in packaging. In preferred form, the multiple use rotary cutting device has a cutting wheel, a frame member, a handle assembly, an accessory cutting mechanism having a accessory cutting surface, and a retracting assembly.

In the preferred embodiment described herein, the multiple use rotary cutting device has a cutting wheel, a frame member with a lower portion having the accessory cutting surface, a handle assembly comprising a handle cover and a handle for partially enclosing the lower portion of the frame member, and a retracting assembly, which in combination with the handle is capable of completely enclosing the lower portion of the frame member and thereby the accessory cutting surface. The retracting assembly is retractable whereby the accessory cutting surface is exposed when needed.

Also in the preferred embodiment, the handle has a lower portion having at least one internal cavity capable of receiving the retracting assembly. When the retracting assembly is retracted into the handle, the lower portion of the frame member with the accessory cutting surface is substantially exposed and capable of use for cutting functions.

Additionally, in the preferred embodiment, the retracting assembly is comprised of a helical spring and an end cap. The end cap has an upper portion and a lower portion with an orifice for receiving the lower portion of the frame member thereby allowing the accessory cutting surface to be exposed when the retracting assembly is compressed. Alternative embodiments may utilize a plurality of spring members, including but not limited to torsional or leaf styles, and may be manufactured from a plurality of materials, including but not limited to metals and plastics.

The multiple use rotary cutting device is capable of alternate uses in addition to its preferred use with food products, and more specifically prepackaged food products. In alternate embodiments, the multiple use rotary cutting device encompasses an accessory cutting mechanism without a retractable cover. In such alternative embodiments, the multiple use rotary cutting device may include a removable cap or sheath-like member for covering the accessory cutting surface. Also in alternate embodiments, the multiple use rotary cutting device may embody various shapes and sizes for facilitating use with different users and different types of food.

The multiple use rotary cutting device may be manufactured from different materials and in different sizes and colors. In the preferred embodiment described herein, the cutting wheel and frame member are comprised of stainless steel; the handle is comprised of a plastic resin, preferably ABS, material; the handle cover is comprised of a rubber-like, preferably santoprene, material; the helical spring is comprised of spring steel; and the end cap is comprised of a plastic resin, preferably ABS material.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 2:
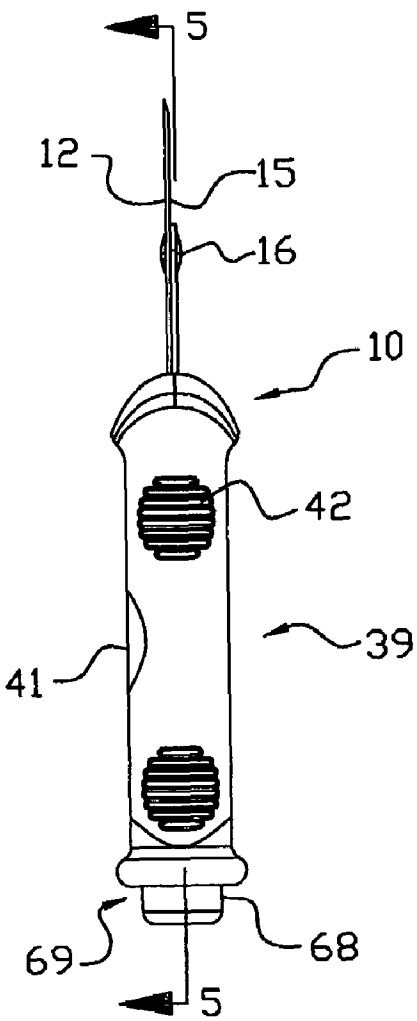
FIG. 2 is a narrow side view of the preferred embodiment of the multiple use rotary cutting device.
Figure 1:
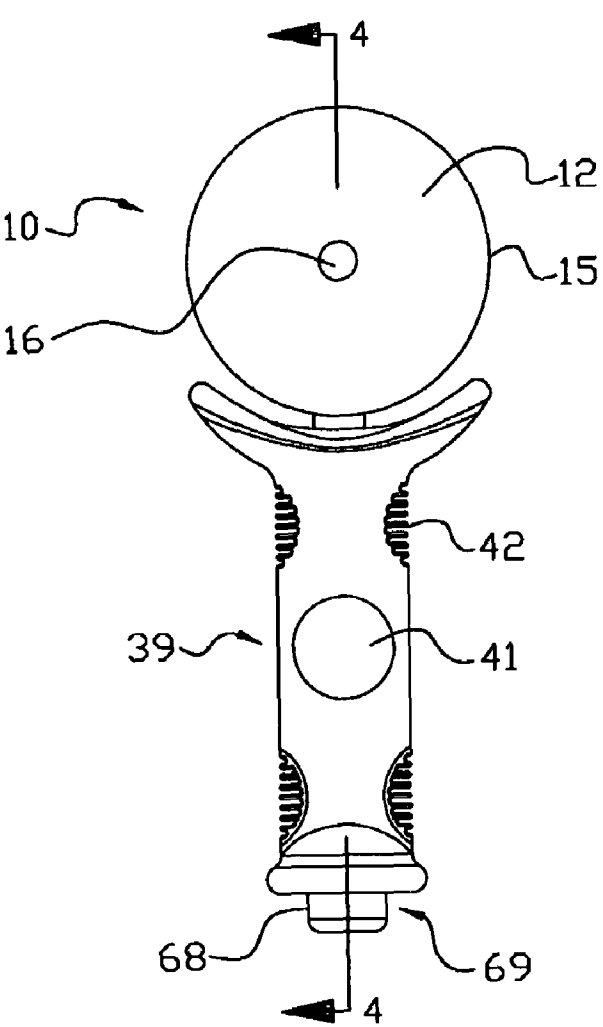
FIG. 1 is a broadside view of a preferred embodiment of the multiple use rotary cutting device.
Figure 3:
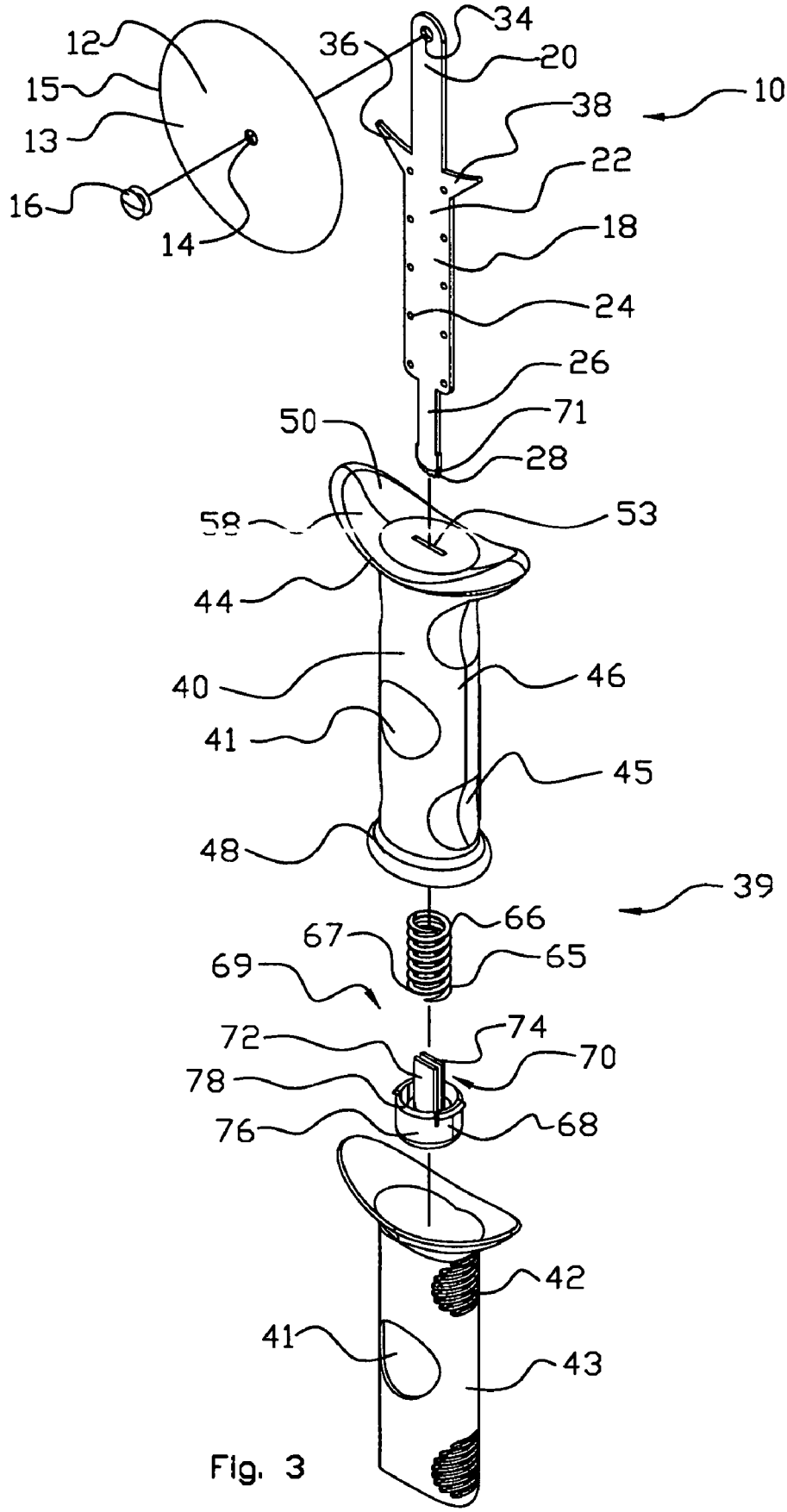
FIG. 3 is a perspective assembly view of the preferred embodiment of the multiple use rotary cutting device.
Figure 6:
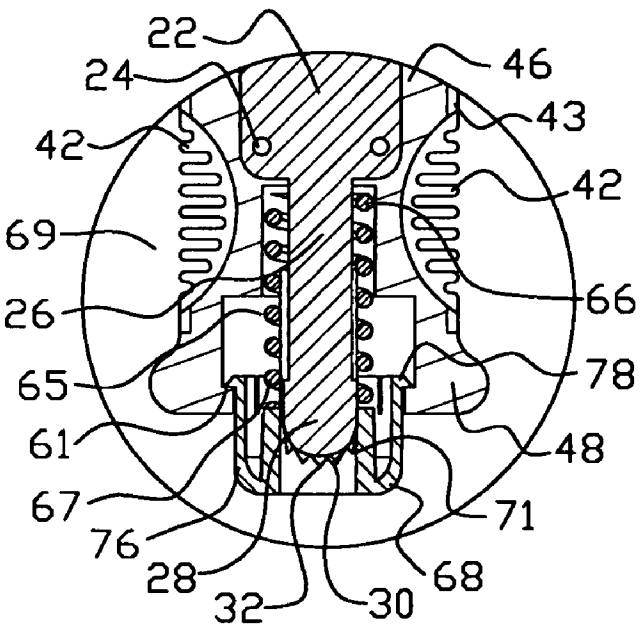
FIG. 6 is a cross sectional exploded view of the lower portion of the preferred embodiment of the multiple use rotary cutting device of FIG. 5.
Figure 5:
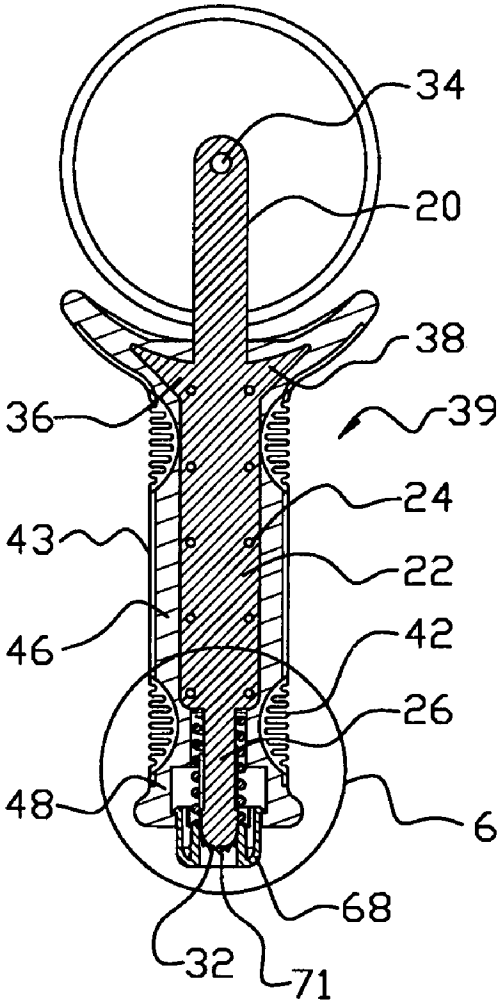
FIG. 5 is another cross sectional view of the preferred embodiment of the multiple use rotary cutting device taken along line 5—5 of FIG. 2.
Figure 4:
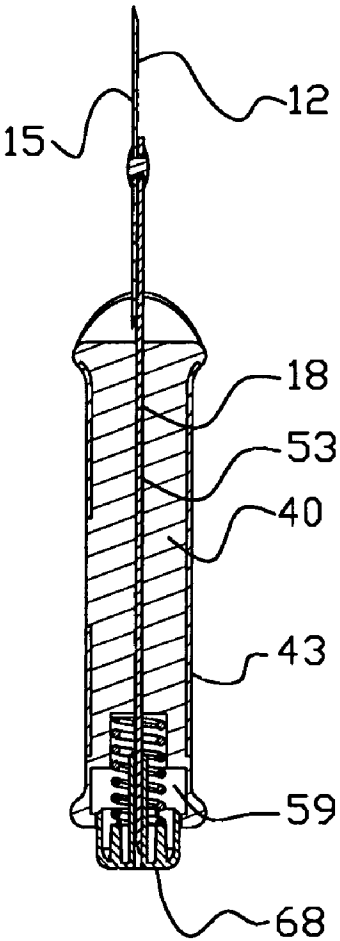
FIG. 4 is a cross sectional view of the preferred embodiment of the multiple use rotary cutting device taken along line 4—4 of FIG. 1.
Figure 9:
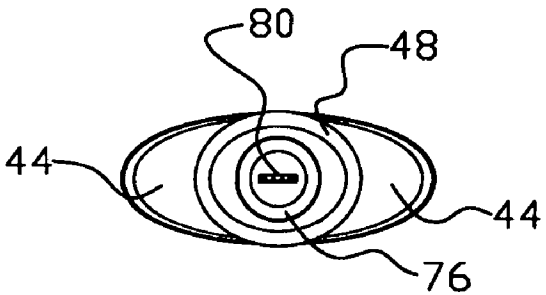
FIG. 9 is a bottom plan view of the preferred embodiment of the multiple use rotary cutting device.

Referring now to the drawings, a preferred embodiment of the multiple use rotary cutting device is shown in FIGS. 1–9. The multiple use rotary cutting device is described in conjunction with prepackaged food products. In the preferred embodiment the multiple use rotary cutting device has a retractable cover or retracting assembly for substantially covering the accessory cutting mechanism when not in use. The accessory cutting mechanism of the rotary cutting device of the present invention is particularly adapted for initially cutting the packaging material of prepackaged food, such as frozen pizzas, in order to facilitate opening of the package. Subsequently, the rotary cutting device is used to cut or section the food, such as pizza, prior to serving.

The drawings show the rotary cutting device 10 comprising a cutting wheel 12, a frame member 18, a handle assembly 39 comprising a handle cover 43 and a handle 40, and an accessory cutting mechanism 71 with an accessory cutting surface 30. In the preferred embodiment, the accessory cutting mechanism 71 is covered by a retracting assembly 69 such that the accessory cutting surface 30 is substantially enclosed when the accessory cutting mechanism 71 is not utilized.

The cutting wheel 12 comprises an aperture 14 and an edge margin 13 having a rotary cutting surface 15. In the preferred embodiment the rotary cutting surface 15 is smooth but in alternate embodiments the rotary cutting surface 15 may have serrations, such as teeth, to improve the cutting performance. Also in the preferred embodiment, the cutting wheel 12 is comprised of stainless steel. Alternative embodiments may utilize cutting wheels 12 manufactured of a plurality of materials, including but not limited to metals or plastics.

In one preferred embodiment, the frame member 18 comprises an upper portion 20 having an aperture 34; a middle portion 22 having a first projection 36, a second projection 38 and one or more assembly apertures 24; and a lower portion 26 having a bottom edge margin 28 with a accessory cutting surface 30. In the preferred embodiment, the accessory cutting surface 30 is an integral part of the frame member 18 and the accessory cutting surface 30 further comprises a serrated edge 32, such as cutting teeth. In the preferred embodiment, the frame member 18 is comprised of stainless steel. In alternate embodiments, the accessory cutting surface 30 may be separate from the frame member 18. Also in alternate embodiments, the accessory cutting surface 30 may be smooth.

The cutting wheel 12 is attached to the upper portion 20 of the frame member 18 by a fastening member 16 passing through both the aperture 14 of the cutting wheel 12 and the aperture 34 of the upper portion 20 of the frame member 18. In the preferred embodiment, the fastening member 16 is a rivet. Alternative embodiments may utilize screws, pins, welds, adhesives, or other fasteners. The fastening member 16 is attached such that the cutting wheel 12 rotates freely.

Figure 8:
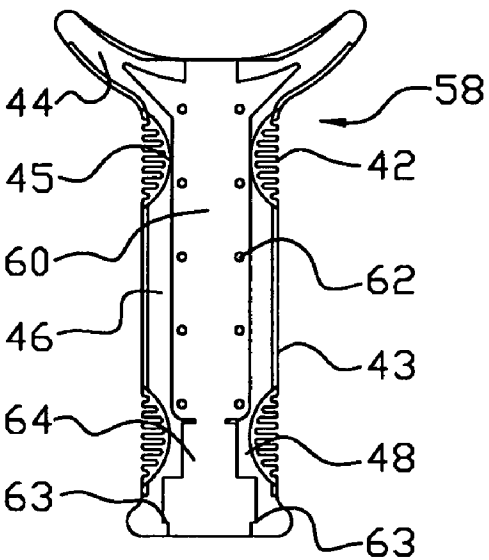
FIG. 8 is a plan view of the second half of the modified T-shaped handle.
Figure 7:
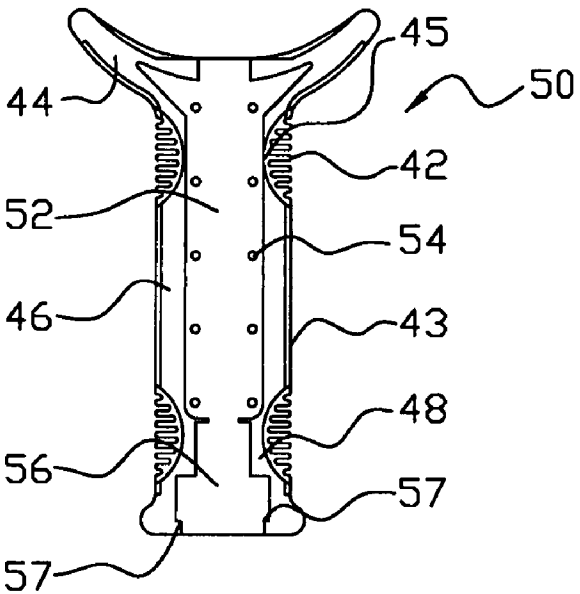
FIG. 7 is a plan view of the first half of the modified T-shaped handle.

Also in a preferred embodiment, the multiple use rotary cutting device comprises a handle assembly 39 further comprising a handle 40 and a handle cover 43. The handle 40 comprises an upper portion 44, a middle portion 46 having one or more external depressions 45, and a lower portion 48. In a preferred embodiment, the handle 40 is comprised of two pieces or halves which are joined together enclosing the frame member 18 and the retracting assembly 69. The view of FIG. 7 shows one of the two pieces, the first half 50 of the handle 40. Also, the view of FIG. 8 shows the other of the two pieces, the second half 58 of the handle 40. Also in the preferred embodiment, the handle 40 comprises indicia 41 such as a logo or trademark.

The first half 50 of the handle 40 comprises a first depression 52 extending through the upper portion 44 and the middle portion 46 of the handle 40 and a second depression 56 extending through the lower portion 48 of the handle 40. The first depression 52 of the first half 50 of the handle 40 is continuous with the second depression 56 of the first half 50 of the handle 40. The first depression 52 further encompassing one or more pins or projections 54 capable of being received by the one or more assembly apertures 24 of the middle portion 22 of the frame member 18. The second depression 56 is shaped such that it further comprises a ledge 57. The one or more pins or projections 54 in combination with the one or more assembly apertures 24 of the middle portion 22 of the frame member 18 provide partial attachment means for securing the frame member 18 to the handle 40.

The second half 58 of the handle 40 comprises a first depression 60 extending through the upper portion 44 and the middle portion 46 of the handle 40 and a second depression 64 extending through the lower portion 48 of the handle 40. The first depression 60 of the second half 58 of the handle 40 is continuous with the second depression 64 of the second half 58 of the handle 40. The first depression 60 further encompasses one or more pins or projections 62 which are capable of being received by the one or more assembly apertures 24 of the middle portion 22 of the frame member 18. The second depression 64 is shaped such that it further comprises a ledge 63. The one or more pins or projections 62 in combination with the one or more apertures 24 of the middle portion 22 of the frame member 18 provide partial attachment means for securing the frame member 18 to the handle 40.

The first depression 52 of the first half 50 and the second depression 56 of the first half 50 in combination with the first depression 60 of the second half 58 and the second depression 64 of the second half 58 form a first internal cavity 53 and a second internal cavity 59 with a ledge 61 when the first half 50 of the handle 40 is joined to the second half 58 of the handle 40. The first internal cavity 53 is preferably continuous with the second internal cavity 59. In a preferred embodiment, the first internal cavity 53 is capable of completely receiving the middle portion 22 of the frame member 18 and partially receiving the upper portion 20 of the frame member 18. Also, the second internal cavity 59 is capable of receiving the retracting assembly 69 and at least partially receiving the lower portion 26 of the frame member 18.

In a preferred embodiment, the handle 40 is of a modified T-shape such that a hand guard is inherently created through the modified T-shape. This prevents possible hand injuries by blocking access to the cutting wheel 12 while in use. The first projection 36 and the second projection 38 of the middle portion 22 of the frame member 18 in conjunction with the middle portion 22 of the frame member 18 itself also forms a modified T-shape. When the multiple use rotary cutting device 10 is assembled during manufacturing, the frame member 18 is placed within the first internal cavity 53 of the middle portion 46 of the handle 40, whereby the frame member 18 substantially mimics the modified T-shape of the preferred embodiment of the handle 40. The interlocking of the modified T-shaped frame member 18 with the modified T-shaped handle 40 provide rigidity, strength, and security. Other shapes and configurations may also be utilized which are best suited for the end-use.

The handle 40 is preferably comprised of an ABS plastic resin although other materials may be used in alternative embodiments. The handle assembly 39 is also comprised of a handle cover 43 which in a preferred embodiment is also a modified T-shape. The handle cover 43 further comprises leaf like projections 42 which align with the one or more external depressions 45 in the middle portion 46 of the handle 40 when the handle cover 43 is installed over the handle 40. The leaf like projections 42 in combination with the one or more external depressions 45 in the middle portion 46 of the handle 40 provide comfort and minimize slippage in use. In the preferred embodiment, the handle cover 43 comprises indicia 41 such as a logo or trademark. Also in the preferred embodiment, the handle cover 43 is comprised of a rubber like santoprene material, but other materials may be used in alternate embodiments.

The retracting assembly 69 is preferably comprised of a helical spring 65 and an end cap 68. The helical spring 65 having a top portion 66 and a bottom portion 67. The end cap 68 having an upper portion 70 and a lower portion 76. In a preferred embodiment, the upper portion 70 comprises a first member 72 and a second member 74 substantially parallel with the first member 72 such that the lower portion 26 of the frame member 18 can be received through a gap between the first member 72 and the second member 74. The upper portion 70 provides stability to the end cap 68 when retracting. Preferably, the lower portion 76 has a shoulder portion 78 and a substantially rectangular shaped aperture 80 capable of receiving the lower portion 26 of the frame member 18 such that the accessory cutting surface 30 is exposed when the end cap 68 is retracted into the second internal cavity 59 of the lower portion 48 of the handle 40. Alternative embodiments may incorporate apertures 80 of various shapes, including but not limited to circular, elliptical, or triangular.

The shoulder portion 78 of the lower portion 76 of the end cap 68 is capable of contacting the ledge 61 when the end cap 68 is not retracted into the handle 40, thereby securing the end cap 68 and covering the accessory cutting surface 30 of the lower portion 26 of the frame member 18. This assures that the accessory cutting surface 30 is substantially safely concealed until adequate pressure is applied when the accessory cutting mechanism 71 is needed. Also in a preferred embodiment, said shoulder portion 78 is capable of flexing toward said upper portion 70 members 72, 74 in order to provide a snap-in assembly feature.

In operation, the rotary cutting device 10 with the accessory cutting mechanism 71 is utilized for both opening prepackaged food products, such as pizza, and cutting or sectioning the food product before or after cooking. The rotary cutting device 10 is held such that the end cap 68 of the retracting assembly 69 faces the prepackaged food product in an area where package opening is desired. The user applies pressure to the rotary cutting device 10 whereby pressure or force is applied onto the prepackaged food product packaging and thereby exposes the accessory cutting surface 30 by causing the end cap 68 of the retracting assembly 69 to retract. This operation exposes the accessory cutting surface 30 of the lower portion 26 of the frame member 18. While maintaining pressure or force, the user pushes and/or pulls the rotary cutting device 10 such that the accessory cutting surface 30 contacts and cuts the packaging of the prepackaged food product. Subsequently, when it is desired to cut or section the food product, the rotary cutting device 10 is held whereby the cutting wheel 12 faces the food. The user applies pressure to the rotary cutting device 10 whereby the cutting wheel 12 presses down or upon on the food product. While maintaining said pressure or force, the user pushes and/or pulls the rotary cutting device 10 such that the rotary cutting surface 15 of the cutting wheel 12 cuts or sections the food product. The aforesaid is not limited for use with food products but may be utilized in alternative applications which require the cutting of non-food based materials and associated packaging.

From the foregoing description those skilled in the art will appreciate that all objects of the present invention are realized. A multiple use rotary cutting device has been shown and described which allows for both packaging cutting of prepackaged food products and cutting or slicing the food product itself. When embodied in a usable device, the art of the present invention is convenient and easy to use. The preferred design of the present invention, as well as alterations that will now be apparent to those skilled in the art, all allow use of the device with any prepackaged food product or alternative application. The device of this invention is further characterized by relatively easy handling and precise control of the cutting action. The present invention, in alternate embodiments, is available in a variety of shapes, sizes, and colors.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A multiple use rotary cutting device, the rotary cutting device comprising:

a frame member having an upper portion and a lower portion; and a cutting wheel rotatably mounted with said upper portion and capable of cutting a food product; and an accessory cutting mechanism substantially opposite said cutting wheel; and a handle assembly mounted with said frame member; and said handle further comprising a lower portion having an internal cavity capable of receiving a retracting assembly such that said retracting assembly is capable of being retracted into said handle thereby exposing said lower portion of said frame member.

2. The multiple use rotary cutting device as defined in claim 1 wherein the frame member further comprises the accessory cutting mechanism at said lower portion.

3. The multiple use rotary cutting device as defined in claim 1 further comprising said retracting assembly which substantially encloses the accessory cutting mechanism such that the retracting assembly is capable of being retracted so that an accessory cutting surface of the accessory cutting mechanism is exposed.

4. A multiple use rotary cutting device, the rotary cutting device comprising:

a cutting wheel;

a frame member having a lower portion with an accessory cutting surface substantially opposite the cutting wheel;

a handle assembly having a handle for partially enclosing the lower portion of the frame member; and a retracting assembly, which in combination with the handle substantially encloses the lower portion of the frame member; and said handle further comprising a lower portion having an internal cavity capable of receiving said retracting assembly such that said retracting assembly is capable of being retracted into said handle thereby exposing said lower portion of said frame member.

5. The multiple use rotary cutting device as defined in claim 4 wherein the retracting assembly is capable of being retracted such that the accessory cutting surface of a bottom edge margin of the lower portion of the frame member is exposed.

6. A multiple use rotary cutting device for cutting or sectioning food products, the rotary cutting device comprising:

a rotary cutting wheel having an aperture;

a frame member having a lower portion with a bottom edge margin having an accessory cutting surface substantially opposite the rotary cutting wheel;

a modified T-shaped handle assembly comprising a handle cover and a handle having a first internal cavity and a second internal cavity which partially encloses the lower portion of the frame member and is capable of enclosing a retracting assembly; and the retracting assembly, which in combination with the handle substantially encloses the lower portion of the frame member, the retracting assembly capable of being retracted into the handle such that the accessory cutting surface of the lower portion of the frame member is exposed.

7. The multiple use rotary cutting device as defined in claim 6 further comprising a frame member having an upper portion, a middle portion, and the lower portion, the upper portion having an aperture which in combination with the aperture of the rotary cutting wheel receives a fastening member such that the rotary cutting wheel is attached to the frame and rotates freely.

8. The multiple use rotary cutting device as defined in claim 6 the modified T-shaped handle further comprising:

an upper portion, a middle portion with one or more external depressions, and a lower portion; and a first half and a second half, the first half having a first depression in the upper portion and middle portion, the second half having a first depression in the upper portion and middle portion, the first depression of the first half in combination with the first depression of the second half forming the first internal cavity when the first half of the modified T-shaped handle is joined to the second half of the modified T-shaped handle; and said first internal cavity capable of partially receiving the frame member.

9. The multiple use rotary cutting device as defined in claim 8 the modified T-shaped handle further comprising:

a second depression in the lower portion of said first half; and a second depression in the lower portion of the second half, the second depression of the first half in combination with the second depression of the second half forming the second internal cavity continuous with the first internal cavity when the first half of the modified T-shaped handle is joined to the second half of the modified T-shaped handle; and said second internal cavity capable of receiving the retracting assembly and at least partially receiving the lower portion of the frame member.

10. The multiple use rotary cutting device as defined in claim 9 wherein both the second depression of the first half of the modified T-shaped handle and the second depression of the second half of the modified T-shaped handle are shaped such that they further comprise a ledge such that the retracting assembly is capable of contacting the ledge when not retracted into the modified T-shaped handle thereby securing the retracting assembly and covering the accessory cutting surface of the lower portion of the frame member.

* * * * *